US006796850B2

(12) United States Patent
Matsui et al.

(10) Patent No.: US 6,796,850 B2
(45) Date of Patent: Sep. 28, 2004

(54) PRESS FITTING TYPE SPRING CONNECTOR

(75) Inventors: Makoto Matsui, Tokyo (JP); Takumi Kutsukawa, Nagano-ken (JP)

(73) Assignees: SMK Corporation, Tokyo (JP); Ito Manufacturing Co., Ltd., Nagano-ken (JP)

( * ) Notice: Subject to any disclaimer, the term of this patent is extended or adjusted under 35 U.S.C. 154(b) by 0 days.

(21) Appl. No.: 10/653,230

(22) Filed: Sep. 3, 2003

(65) Prior Publication Data

US 2004/0161981 A1 Aug. 19, 2004

(30) Foreign Application Priority Data

Feb. 13, 2003 (JP) ..... 2003-035648

(51) Int. Cl.[7] ..... H01R 13/24
(52) U.S. Cl. ..... 439/700
(58) Field of Search ..... 439/700, 627, 439/761, 827; 324/761

(56) References Cited

U.S. PATENT DOCUMENTS 5,681,187 A * 10/1997 Fukushima et al. ..... 439/700
5,921,823 A * 7/1999 Bernardini ..... 439/889

FOREIGN PATENT DOCUMENTS

JP 2000-251995 A 9/2000
JP 2001-93593 A 4/2001
JP 2002-56914 A 2/2002

* cited by examiner

*Primary Examiner*—Neil Abrams
*Assistant Examiner*—Phuong Dinh
(74) *Attorney, Agent, or Firm*—Foley & Lardner LLP

(57) ABSTRACT

With the press fitting type spring connector of the present invention, a contact pin 20 having a space inside is housed inside a space of a tube 10 in a slidable manner, along the axial center of the tube 10. A spring shaped touch ring 30 is mounted on an outer surface of the contact pin 20. Of two coils of the touch ring 30, the second coil has a larger diameter than the first coil, the first coil is always in contact with the contact pin 20, and the second coil is always in contact with the tube 10. A coil spring 40 has a tip housed inside the space of the contact pin 20, and a base section housed inside the tube 10.

Accordingly, with the press fitting type spring connector of the present invention, housing the contact pin 20 inside the tube 10 along the axial center of the tube 10 makes it possible to always obtain stable electrical characteristics because of the touch ring 30 provided on the outer surface of the contact pin 20, and enables miniaturization.

8 Claims, 3 Drawing Sheets

PRESS FITTING TYPE SPRING CONNECTOR

BACKGROUND OF THE INVENTION

1. Technical Field

The present invention relates to a press fitting type spring connector used in parts that have removable electrical connections, in various types of electrical machines.

2. Related Art

As shown, for example, in claim 1 and FIG. 2 of Japanese Patent Laid-open No. 2002-56914 (related art 1), with a press fitting type spring connector, when a pin terminal slides, as well as preventing contact failure by causing the pin terminal to be pressed against an inner surface of a pin terminal insertion section that has a terminal section inclined, burning of the structural components is also prevented by removing foreign matter that infiltrates into contact sections of the pin terminal and the inner surface of a tube.

Also, as shown in claim 1 and FIG. 1 of Japanese Patent Laid-open No. 2001-93593 (related art 2), by providing an inclined surface on a contact pin rear end, the contact pin is inclined and pressed against the inner surface of a tube.

Further, as shown in claim 1 and FIG. 1 of Japanese Patent Laid-open No. 2000-251995 (related art 3), by bringing a compression coil spring tip end projection section into contact with a contact pin rear end, the contact pin is inclined and also comes into contact with an inner wall of a tube.

However, with the "electrical connection device and connection unit" of related art 1, in the case where an electrical contact terminal section of an electrical device comes into contact with a pin terminal tip, since the pin terminal is inclined, there is a problem that it is not always possible to guarantee stable electrical characteristics.

Similarly, with the "contacting type connection device" of related art 2 and the "connector for electrical connection" of related art 3, in the case where an electrical contact terminal section of an electrical device comes into contact with a pin terminal tip, since the contact pin is inclined, there is a problem that it is not always possible to guarantee stable electrical characteristics.

SUMMARY OF INVENTION

The present invention is a press fitting type spring connector, comprising a tube having an opening section provided at one end and a space inside, a contact pin, stored inside the tube capable of sliding, having a tip projecting from the opening section of the tube and with a contact member mounting section provided on an outer surface, a contact member, mounted on the contact member mounting section of the contact pin, and having a section contacting the contact pin and a section contacting the inner surface of the tube, and a coil spring, stored inside the tube, for urging the contact pin tip so as to project.

Operation of the present invention is as described in the following.

The contact terminal section of an electronic device etc. is brought into contact with the tip of the contact pin. In doing so, energization force is applied in a tube base direction, and the contact pin starts to move in the tube base direction while causing the coil spring to be compressed. Then, the contact pin stops, in a state where the tip projects from the tube. Next, a connection terminal section of an electronic device etc. is distanced from the tip of the contact pin. In doing this, the energization force in the tube base direction is removed, and the contact pin starts to move in the tube tip direction due to elastic force of the coil spring, and stops at a regular position.

Part of the contact member normally comes into contact with the contact pin, and another part contacts the inner surface of the tube, which means that there is little electrical resistance between the contact pin and the tube, and stable electrical characteristics can be obtained.

Also, since the coil spring is housed inside the contact pin up to the tip, it is possible to make a distance from the contact pin tip to the other end of the tube short.

DESCRIPTION OF THE PREFERRED EMBODIMENT

Figure 1:
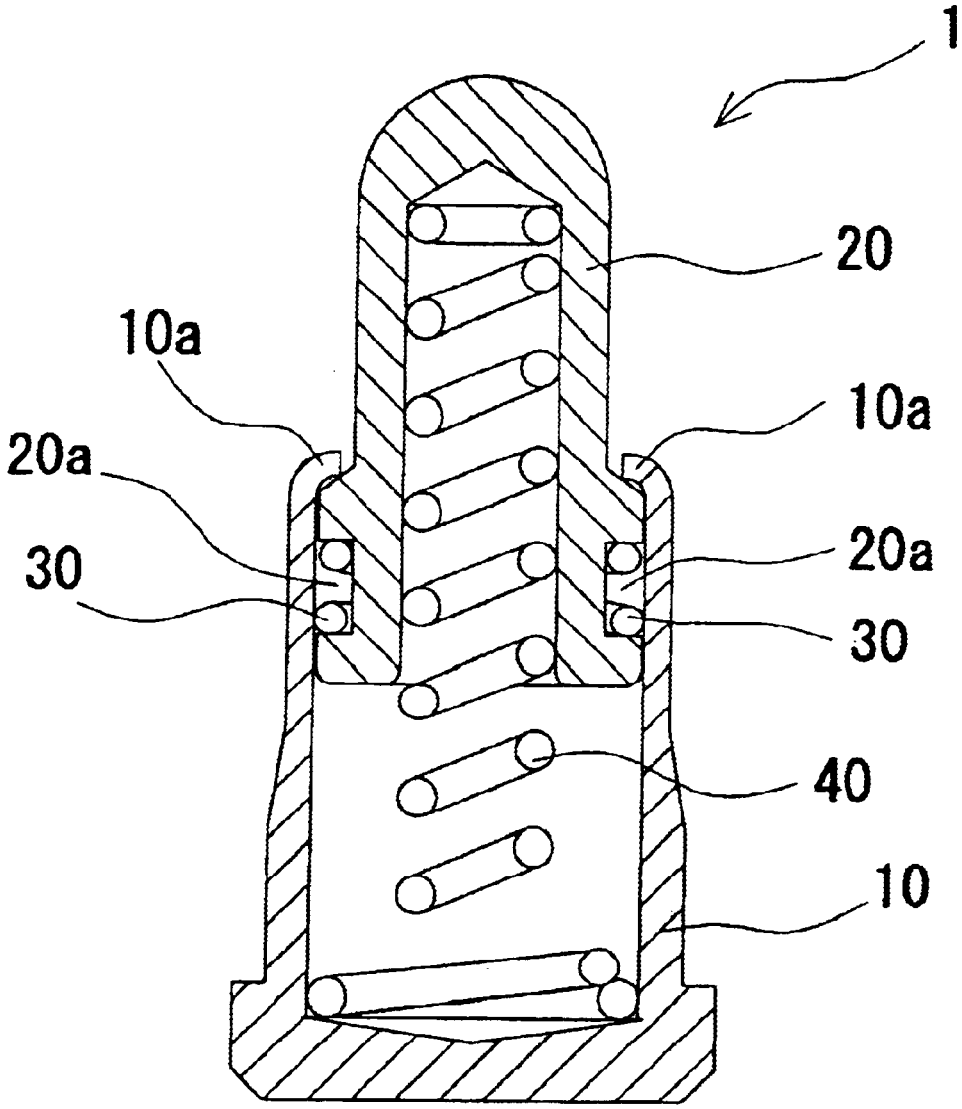
FIG. 1 is a front cross-sectional drawing of a regular state of a press fitting type spring connector of the present invention.

The press fitting type spring connector 1 of the embodiment of the invention comprises a tube 10, a contact pin 20, a touch ring 30 and a coil spring 40.

Figure 2:
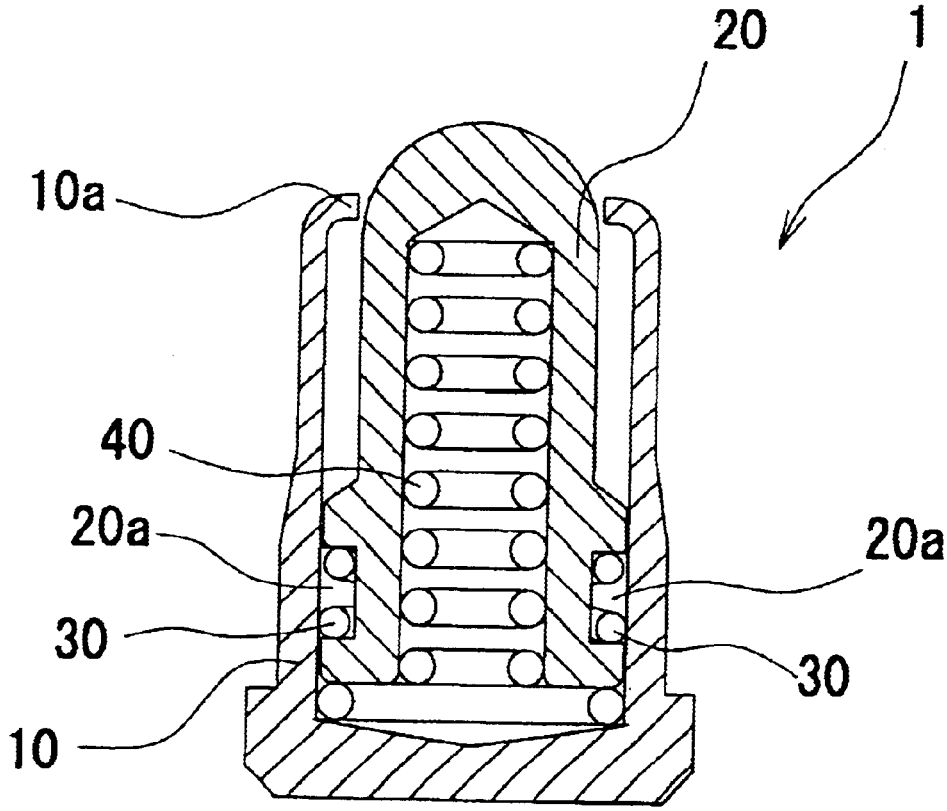
FIG. 2 is a front cross-sectional drawing of a compressed state of the press fitting type spring connector of the present invention.

As shown in FIG. 1 and FIG. 2, the tube 10 is cylindrical and has a space inside. An opening section is provided on one end, and the edge of the opening section is provided with a contact pin abutment section 10*a* that narrows inwardly. The other end is formed into a flat surface perpendicular to the axial center of the tube 10, by deforming the edge. The contact pin 20 is provided inside the tube 10.

The tube 10 of this embodiment has one end closed off, but it is also possible to have both ends open and to fit a cover into one end to close the open end up.

As shown in FIG. 1 and FIG. 2, the contact pin 20 is cylindrical in shape, and has a space inside. The tip is formed hemispherical in shape, and has a smaller diameter than a base section. The base section is open, has a slightly larger diameter than the tip, but a slightly smaller diameter than the internal diameter of the tube 10, and has a touch ring mounting section 20*a*, formed as a groove, provided on an outer surface. The touch ring 30 is mounted on the touch ring mounting section 20*a*, being a contact member mounting section. The contact pin 20 has a tip projecting from one end of the tube 10 provided with the contact pin abutment section 10*a*, and is housed inside the tube 10 so as to be capable of sliding along the axial center of the tube 10. Also, the contact pin 20 has a base section that abuts against the contact pin abutment section 10*a* of the tube 10, to restrict projection of the tip. A coil spring 40 is provided inside the contact pin 20. Therefore, compared to the related art, it is possible to shorten the length of the tube 10, enabling miniaturization of the spring connector. It is also possible to obtain sufficient coil spring length even if the tube 10 is shortened, enabling prolonged component life.

Only one contact pin 20 is used in this embodiment, but it is also possible to use two contact pins provided with respective tips projecting from both ends of the tube 10. In this case, contact pin abutment sections 10*a* are provided on edges of both open ends of the tube 10. Also, the touch ring mounting section 20*a* of this embodiment is formed as a groove, but it can also be formed in another shape, for example in the shape of a projection, as long as it is possible to mount the touch ring 30. Further, the contact pin 20 has a space inside, but it is possible to have a form where the space is not provided.

Figure 3:
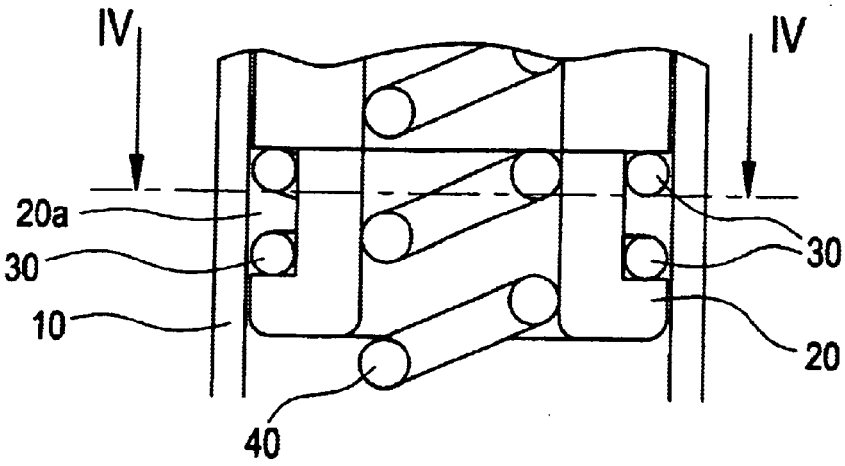
FIG. 3 is an enlarged cross-sectional drawing of a base part of the press fitting type spring connector of the present invention.
Figure 4:
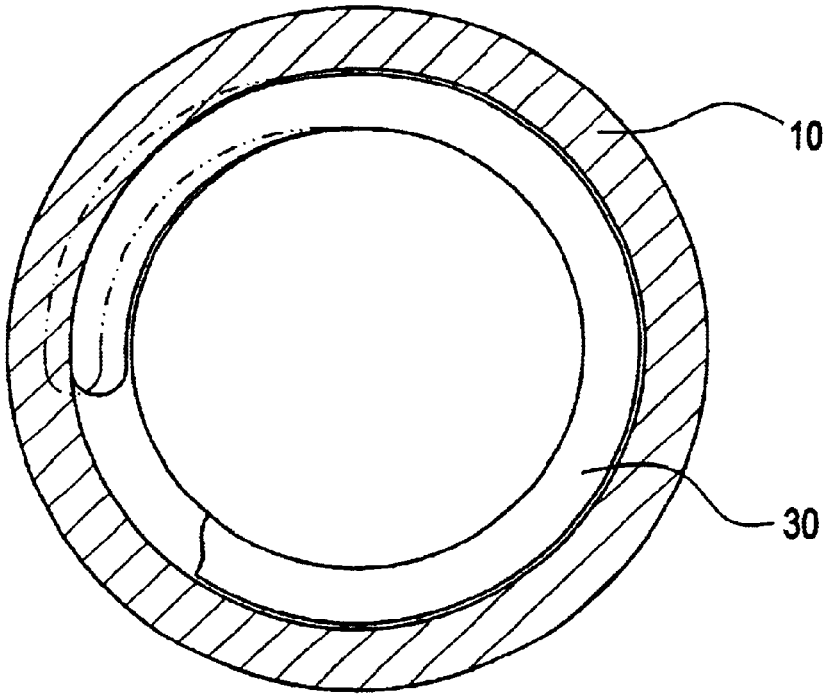
FIG. 4 is a partial cross-sectional drawing along line IV—IV FIG. 3.

The touch ring 30 is a contact member. As shown in FIG. 1 to FIG. 3, the touch ring 30 is made up of two coils, and is provided inside the touch ring mounting section 20*a* of the contact pin 20. As shown in FIG. 3, of the two coils of the touch ring 30, the second has a larger diameter than the first. As a result, the first coil of the touch ring 30 comes into contact with an outer side surface of the contact pin 20, while the second coil comes into press contact with the inner surface of the tube 10, as shown in FIG. 4. Specifically, since part of the touch ring 30 is always in contact with the contact pin 20 while another part is in contact with the inner surface of the tube 10, there is little variation in electrical resistance between the contact pin 20 and the tube 10, and stable electrical characteristics are obtained. In this way, the touch ring 30 always obtains stable electrical characteristics because the contact pin 20 is always in contact with the tube 10.

The touch ring 30, as the contact member of this embodiment, has two coils, but it is also possible to have more than two coils, or even just one coil. Also, the touch ring 30 can be shaped like a ball, a projection or the like as long as it is always in contact with the tube 10 and the contact pin 20. It is also possible to provide a plurality of touch rings 30, and in that case the same number of touch ring mounting sections 20*a* as there are touch rings 30 are also provided on the outer surface of the contact pin 20. Further, the touch ring 30 is provided on the base of the contact pin 20, but can also be provided at another part of the contact pin 20.

The coil spring 40 is formed with a tip having a smaller diameter than the inner diameter of the contact pin 20. The base is formed with a slightly smaller diameter than the inner diameter of the tube 10. The coil spring 40 has a tip that comes into contact with the bottom surface of the inside of the tip of the contact pin 20, and is urged so that the tip of the contact pin 20 projects from the end of the tube 10 provided with the contact pin abutment section 10*a*. Further, the base section of the coil spring 40 is formed with a large diameter, and the coil spring 40 is fitted stably in the base of the tube 10 so as not to move in the horizontal direction.

The coil spring 40 does not get suppressed by contact pressure acting in the inner surface direction of the tube 10 due to the touch ring 30, and can slide inside the tube 10 in the axial direction of the tube 10. Also, since the coil spring 40 is capable of being housed up to the inside of the contact pin 20, a sufficient coil spring length is 10 obtained and it is possible to prolong the life of the coil spring 40.

With this embodiment, the tip of the coil spring 40 contacts the bottom surface of the inside of the contact pin 20, but if a space is not provided inside the contact pin 20 and the base is closed, the tip of the coil spring 40 can contact the closed surface of the base section.

By having the touch ring mounting section 20*a* provided on the base section of the contact pin 20, when sliding the contact pin 20, contact pressure between the touch ring 30 and the tube 10 is small and it is easy for the press fitting type spring connector of this embodiment to slide.

Next, operation of the press fitting type spring connector of this embodiment of the invention will be described. As shown in FIG. 1, at a regular time, the contact pin 20 is urged in the direction of the opening section of the tube 10 by the coil spring 40 so that the tip projects from the open end of the tube 10.

A connection terminal of an electronic device or the like is brought into press contact with the tip of the contact pin 20. In doing this, energization force is applied in the tube 10 base direction, and the contact pin 20 contacts the inner surface of the tube 10 via the touch ring 30, and starts to move in the tube 10 base section direction while compressing the coil spring 40. Then, as shown in FIG. 2, the contact pin 20 is stopped with the tip projecting from the tube 10.

Next, the connection terminal section of the electronic device is taken away from the tip of the contact pin 20. As a result of this, there is no longer the energization force in the tube 10 base section direction, and the contact pin 20 contacts the inner surface of the tube 10 via the touch ring 30 and starts to move in the direction of the open end of the tube 10 due to the elastic force of the coil spring 40, and stops at the regular position shown in FIG. 1.

According to the present invention, since the contact pin always contacts the tube through the touch ring, when the contact pin slides, there is little variation in the electrical resistance between the contact pin and the tube, and stable electrical characteristics are obtained. Because the contact pin is housed along the axial center of the tube, it is possible to obtain stable electrical characteristics. Since the coil spring is housed up to the inside of the contact pin, it is possible to shorten the length of the tube and enabling miniaturization. Also, sufficient coil spring length is obtained even with a short tube, and it is possible to use a long coil spring which means that it is possible to prolong the life of the coil spring.

What is claimed is:

1. A press fitting type spring connector, comprising:

a tube having an opening section provided at one end and a space inside;

a contact pin, stored inside the tube capable of sliding, having a tip projecting from the opening section of the tube and with a touch ring mounting section provided on an outer surface;

a touch ring, mounted on the touch ring mounting section, and having a section contacting the contact pin and a section contacting an inner surface of the tube; and a coil spring, stored inside the tube, for urging the contact pin tip so as to project from the opening section of the tube.

2. The press fitting type spring connector of claim 1, wherein the contact pin has an open section at its base and the contact pin has a space inside.

3. The press fitting type connector of claim 1 or claim 2, wherein the coil spring is housed inside the contact pin.

4. A press fitting type spring connector, comprising:

a tube having an opening section provided at one end and a space inside;

a contact pin, stored inside the tube capable of sliding, having a tip projecting from the opening section of the tube and having a base with a touch ring mounting section provided on an outer surface at the base;

a touch ring, mounted on the touch ring mounting section, and having a section contacting the contact pin and a section contacting an inner surface of the tube; and a coil spring, stored inside the tube, for urging the contact pin tip so as to project from the opening section of the tube.

5. The press fitting type spring connector of claim 4, wherein the touch ring comprises a plurality of coils.

6. The press fitting type spring connector of claim 5, wherein a first touch ring coil has a diameter different from the diameter of a second touch ring coil.

7. The press fitting type spring connector of claim 1, wherein the touch ring comprises a plurality of coils.

8. The press fitting type spring connector of claim 7, wherein a first touch ring coil has a diameter different from the diameter of a second touch ring coil.

* * * * *